US006544113B1

(12) United States Patent
Wheeler

(10) Patent No.: US 6,544,113 B1
(45) Date of Patent: Apr. 8, 2003

(54) ADJUSTABLE FLEXIBILITY SANDING APPARATUS

(76) Inventor: John W. Wheeler, 8120 E. Pt. Douglas Rd., Apt. 305, Cottage Grove, MN (US) 55016

( * ) Notice: Subject to any disclaimer, the term of this patent is extended or adjusted under 35 U.S.C. 154(b) by 203 days.

(21) Appl. No.: 09/644,622

(22) Filed: Aug. 23, 2000

Related U.S. Application Data

(60) Provisional application No. 60/152,308, filed on Aug. 30, 1999.

(51) Int. Cl.[7] ..... B24B 23/00
(52) U.S. Cl. ..... 451/495
(58) Field of Search ..... 451/495, 525, 451/524, 530, 538, 539, 913; 29/76.1, 76.2, 76.3, 76.4, 79, 80

(56) References Cited

U.S. PATENT DOCUMENTS

| | | | | | |
|---|---|---|---|---|---|
| 2,457,045 | A | | 12/1948 | Kitterman | |
| 3,089,294 | A | * | 5/1963 | Cowley | 451/490 |
| 3,557,496 | A | | 1/1971 | Martin | |
| 3,699,729 | A | | 10/1972 | Garvey et al. | |
| 4,676,031 | A | | 6/1987 | Reiter | |
| 5,337,523 | A | * | 8/1994 | Walsh | 15/245 |
| 5,662,519 | A | | 9/1997 | Arnold | |
| 5,669,808 | A | * | 9/1997 | Simons | 29/76.1 |
| 5,954,571 | A | * | 9/1999 | Case | 451/354 |
| 6,042,462 | A | * | 3/2000 | Baratti | 451/533 |

* cited by examiner

*Primary Examiner*—Joseph J. Hail, III
*Assistant Examiner*—Anthony Ojini

(57) ABSTRACT

A sanding apparatus includes a flexible base member which includes a base member bottom side and a base member top side. A quantity of abrasive material, e.g. a sheet of sandpaper, is adhesively attached to the base member bottom side. A flexible handle is positioned above the base member top side. Attachment means are provided for attaching the flexible base member to the flexible handle. Rod reception brackets are attached to the base member top side, and one or more flexibility adjustment rods are received in the rod reception brackets. The rod reception brackets include bracket rod reception channels which receive the flexibility adjustment rods. The flexible handle includes handle rod reception channels which are in registration with the bracket rod reception channels. Rod reception tubes are received in the bracket rod reception channels and the handle rod reception channels. The bracket rod reception channels are positioned adjacent to the base member top side such that the rod reception tubes are flush with the base member top side when the rod reception tubes are installed in the bracket rod reception channels. The flexibility adjustment rods are provided as a set of a plurality of flexibility adjustment rods which are increasing resistance to bending. The flexible handle includes a pair of finger grip grooves. The means for attaching the flexible base member to the flexible handle includes attachment wings on the rod reception brackets, and wing reception slots are provided in the flexible handle for receiving the attachment wings.

19 Claims, 5 Drawing Sheets

FIG 1
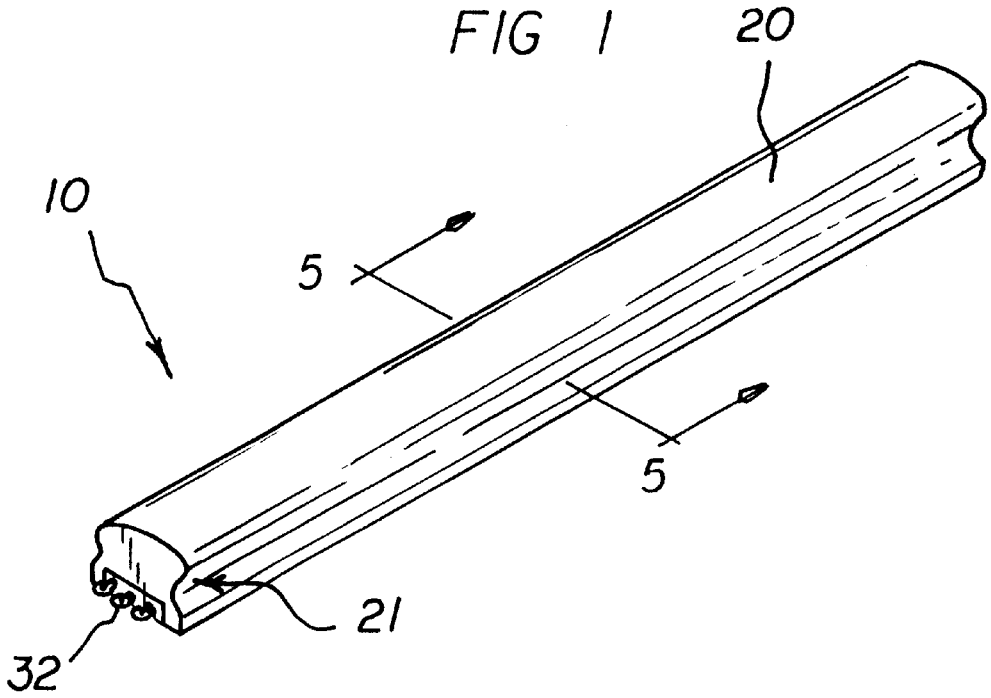
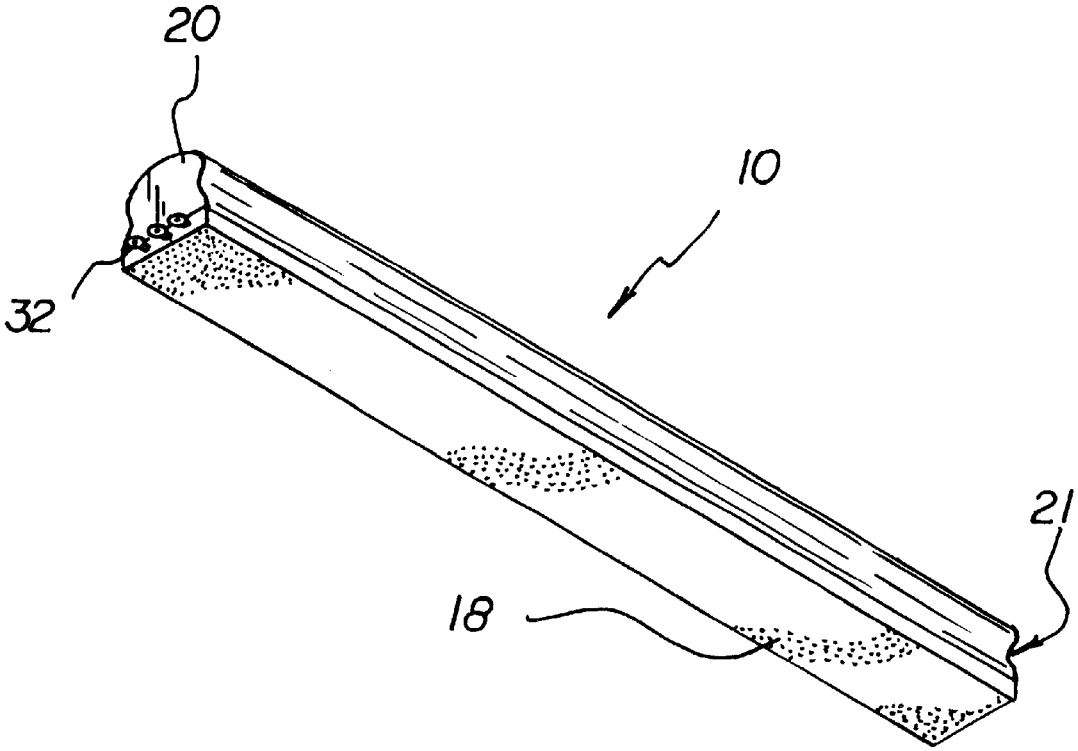
FIG 2

FIG 5
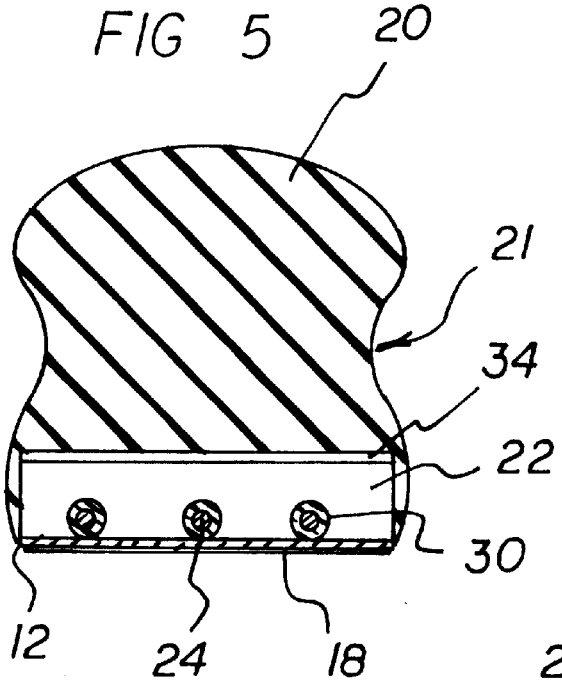
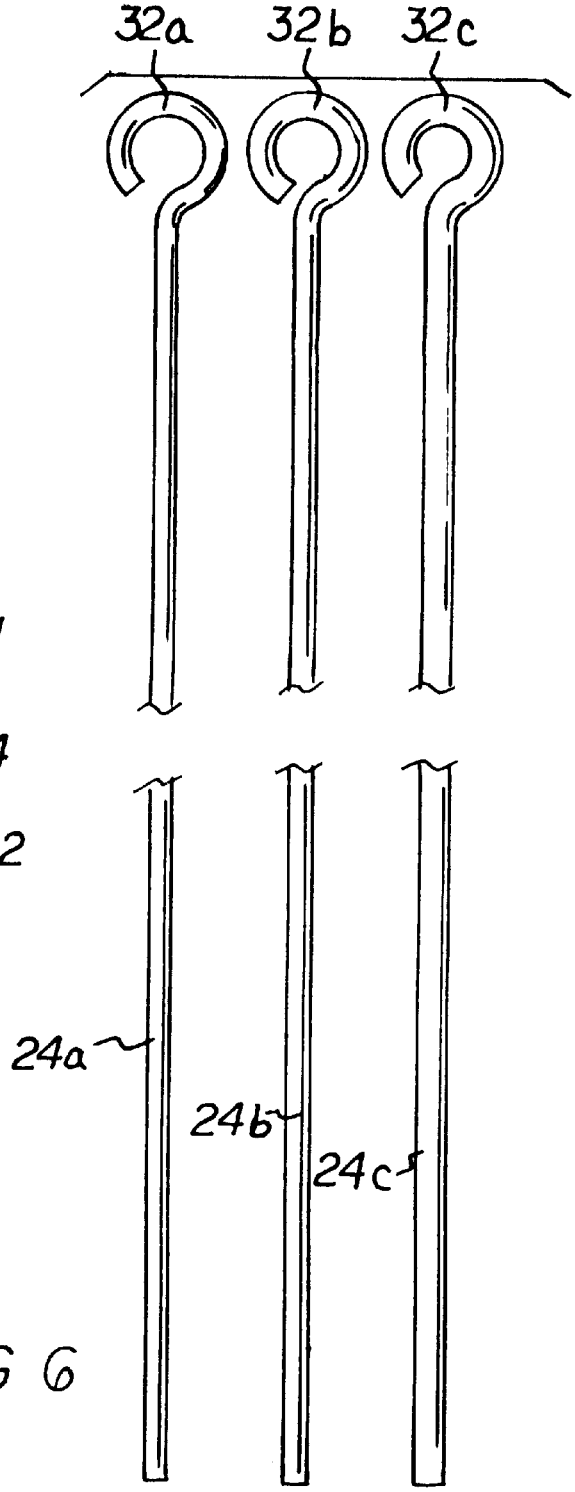
FIG 6

ADJUSTABLE FLEXIBILITY SANDING APPARATUS

CROSS-REFERENCE TO RELATED APPLICATION

This application claims priority based upon my copending Provisional Application Ser. No. 60/152,308, filed Aug. 30, 1999.

BACKGROUND OF THE INVENTION

1. Field of the Invention

The present invention relates generally to sanding blocks and, more particularly, to sanding blocks that are flexible so that they can be used for sanding curved objects.

2. Description of the Prior Art

Throughout the years, a number of innovations have been developed relating to hand-held sanding blocks, and the following U.S. patents are representative of some of those innovations: U.S. Pat. Nos. 2,457,045, 3,557,496, 3,699,729, 4,676,031, and 5,662,519. Among these patents, each of U.S. Pat. Nos. 3,557,496, 3,699,729, and 5,662,519 discloses a hand-held sanding device that includes a flexible abrasive portion that is suitable for sanding curved objects. In addition, each of U.S. Pat. Nos. 2,457,045 and 4,676,031 may be of interest for its disclosure of a hand-held sanding device that includes a rigid, planar abrasive portion.

More specifically, U.S. Pat. No. 3,557,496 discloses a flexible abrasive tool that has a flexible abrasive substrate and two rigid handles located at opposite ends of the substrate. For most efficient operation, two hands are needed to grasp the two handles. However, for many purposes, it would be desirable if a flexible hand-held sanding device could be used that only requires one hand for efficient usage.

U.S. Pat. No. 3,699,729 discloses a hand-held sanding tool in which a flexible sanding belt is spaced apart from a handle. Because the work-contacting portion of the sanding belt is spaced apart from the handle, a limited amount of pressure can be applied to the sanding belt. To apply greater pressure to a hand-held sanding device, it would be desirable if the work-contacting portion is in direct contact with handle.

U.S. Pat. No. 5,662,519 discloses a hand-held sanding device which includes a flexible sanding portion and a flexible handle. However, the flexibility of the handle is constant. There is no provision for adjusting the flexibility of the handle. There are circumstances, however, when it would be desirable if the flexibility of the handle could be adjusted. Flexibility adjustments of the handle may be desirable for objects to be sanded that have differing radii of curvature. Also, flexibility adjustments of the handle may be desirable for different flexible abrasive-holding portions.

Still other features would be desirable in hand-held sanding device. Not only would it be desirable if the flexibility of the handle could be adjusted, it would be desirable if the adjustment of the flexibility of the handle could be carried out in distinct increments. Moreover, it would be desirable if the incremental adjustment of handle flexibility could be accomplished by interchangeable, modular flexibility adjustment elements.

Thus, while the foregoing body of prior art indicates it to be well known to use hand-held sanding devices that have flexible work-contacting abrasive-carrying elements, the prior art described above does not teach or suggest an adjustable flexibility sanding apparatus which has the following combination of desirable features: (1) requires only one hand for efficient usage; (2) has a work-contacting portion that is in direct contact with the handle that supports the work-contacting portion; (3) provides for adjustment of the flexibility of the handle; (4) provides for handle flexibility adjustments to be carried out in distinct increments; and (5) provides that incremental adjustment of handle flexibility is accomplished by interchangeable, modular flexibility adjustment elements. The foregoing desired characteristics are provided by the unique adjustable flexibility sanding apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a sanding apparatus which includes a flexible base member which includes a base member bottom side and a base member top side. A quantity of abrasive material is attached to the base member bottom side. A flexible handle is positioned above the base member top side, and attachment means are provided for attaching the flexible base member to the flexible handle. The adjustable flexibility sanding apparatus of the invention can be bent and curved to be used for sanding curved surfaces, such as curved surfaces on automobile bodies. The flexible handle includes a pair of finger grip grooves. The flexible base member is made from stainless steel. The abrasive material is in a form of a sheet of sandpaper which is adhesively bonded to the base member bottom side.

Rod reception brackets are attached to the base member top side, and one or more flexibility adjustment rods are received in the rod reception brackets. The rod reception brackets include bracket rod reception channels which receive the flexibility adjustment rods. Each of the rod reception brackets includes three bracket rod reception channels.

The attachment means for attaching the flexible base member to the flexible handle can include adhesive action between the flexible handle and the flexible base member when the flexible handle is molded to the flexible base member. In this respect, the flexible handle can be made from a flexible foam material.

Also, the attachment means for attaching the flexible base member to the flexible handle can include attachment wings on the rod reception brackets and wing reception spaces in the flexible handle which receive the attachment wings. The flexible handle includes handle rod reception channels which are in registration with the bracket rod reception channels. Flexible plastic rod reception tubes are received in the bracket rod reception channels and the handle rod reception channels. Preferably, the bracket rod reception channels are positioned adjacent to the base member top side such that the rod reception tubes are flush with the base member top side when the rod reception tubes are installed in the bracket rod reception channels. In addition, each of the flexibility adjustment rods includes a rod handle portion.

The flexibility adjustment rods can be provided as a set of a plurality of flexibility adjustment rods which have increasing resistance to bending.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable flexibility sanding apparatus which has all of the advantages of the prior art and none of the disadvantages.

It is another object of the present invention to provide a new and improved adjustable flexibility sanding apparatus which may be easily and efficiently manufactured and marketed.

It is a further object of the present invention to provide a new and improved adjustable flexibility sanding apparatus which is of durable and reliable construction.

An even further object of the present invention is to provide a new and improved adjustable flexibility sanding apparatus which is susceptible of a low cost of manufacture with regard to both materials and labor, and which accordingly is then susceptible of low prices of sale to the consuming public, thereby making such adjustable flexibility sanding apparatus available to the buying public.

Still yet a further object of the present invention is to provide a new and improved adjustable flexibility sanding apparatus which requires only one hand for efficient usage.

Still another object of the present invention is to provide a new and improved adjustable flexibility sanding apparatus that has a work-contacting portion that is in direct contact with the handle that supports the work-contacting portion.

Yet another object of the present invention is to provide a new and improved adjustable flexibility sanding apparatus which provides for adjustment of the flexibility of the handle.

Even another object of the present invention is to provide a new and improved adjustable flexibility sanding apparatus that provides for handle flexibility adjustments to be carried out in distinct increments.

Still a further object of the present invention is to provide a new and improved adjustable flexibility sanding apparatus which provides that incremental adjustment of handle flexibility is accomplished by interchangeable, modular flexibility adjustment elements.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a top perspective view showing a preferred embodiment of the adjustable flexibility sanding apparatus of the invention.

FIG. 2 is a bottom perspective view of the embodiment of the adjustable flexibility sanding apparatus shown in FIG. 1.

FIG. 5 is a cross-sectional view of the embodiment of the invention shown in FIG. 1 taken along line 5—5 thereof.

FIG. 6 is a plan view of a series of flexibility adjustment rods used with the invention.

DESCRIPTION OF THE PREFERRED EMBODIMENT

With reference to the drawings, a new and improved adjustable flexibility sanding apparatus embodying the principles and concepts of the present invention will be described.

Figure 3:
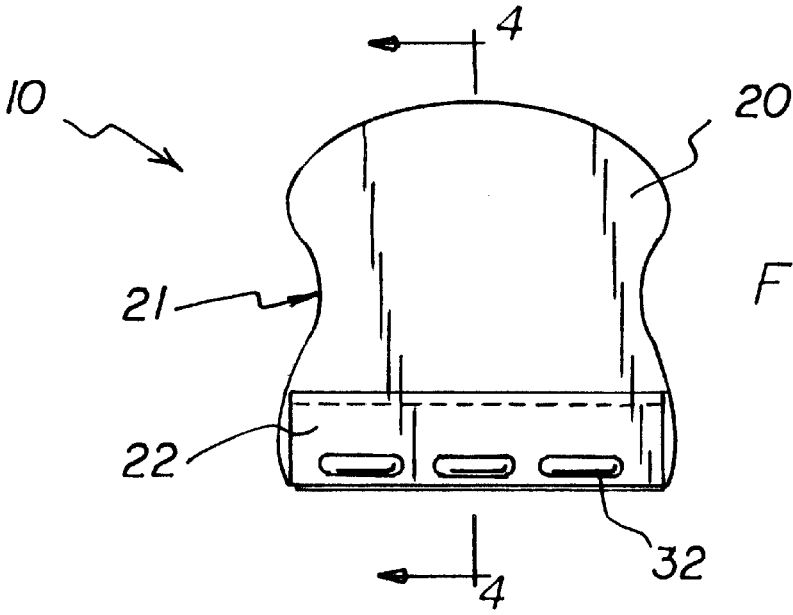
FIG. 3 is an enlarged end view of the embodiment of the adjustable flexibility sanding apparatus of FIG. 1.
Figure 4:
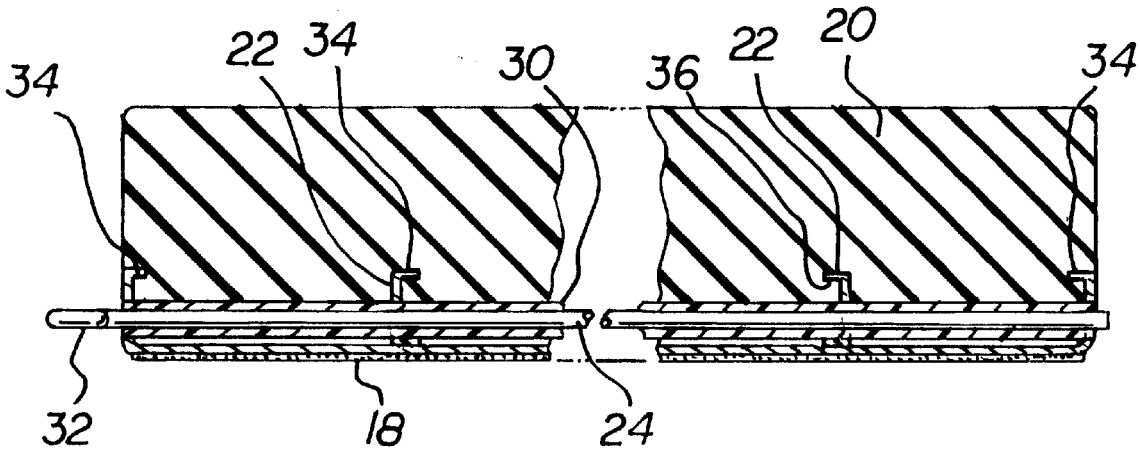
FIG. 4 is a cross-sectional view of the embodiment of the invention shown in FIG. 3 taken along line 4—4 thereof.
Figure 7:
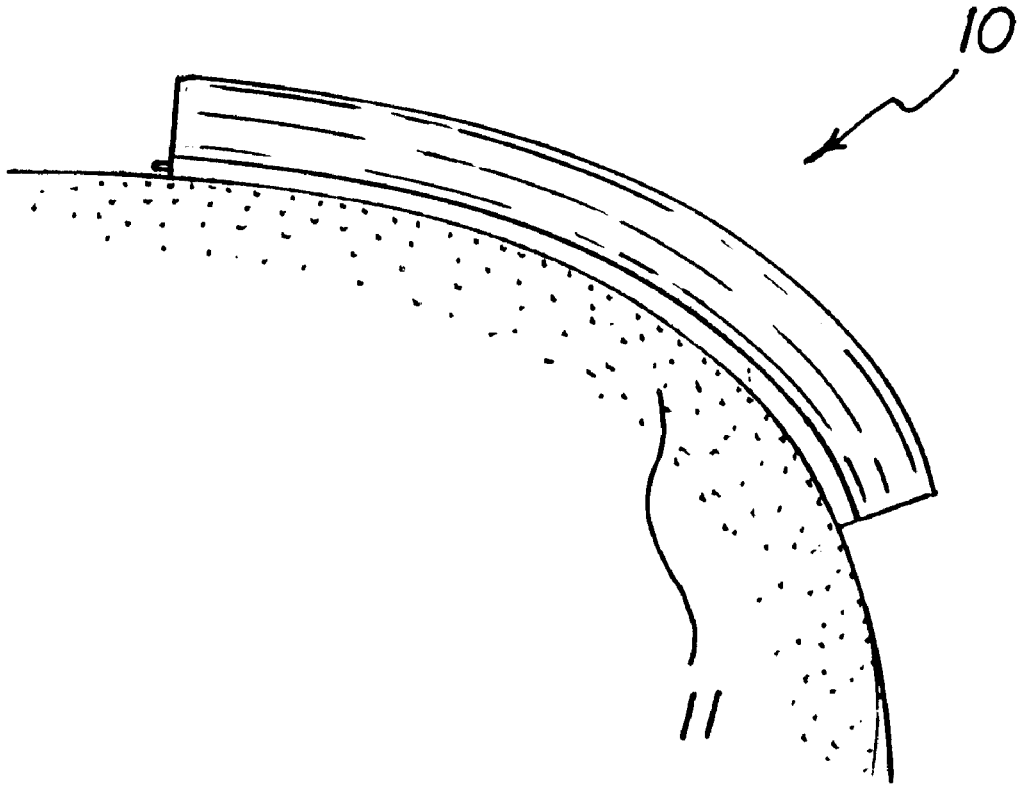
FIG. 7 is a side view of the embodiment of the invention shown in FIGS. 1–5 used on a curved automobile fender surface.
Figure 8:
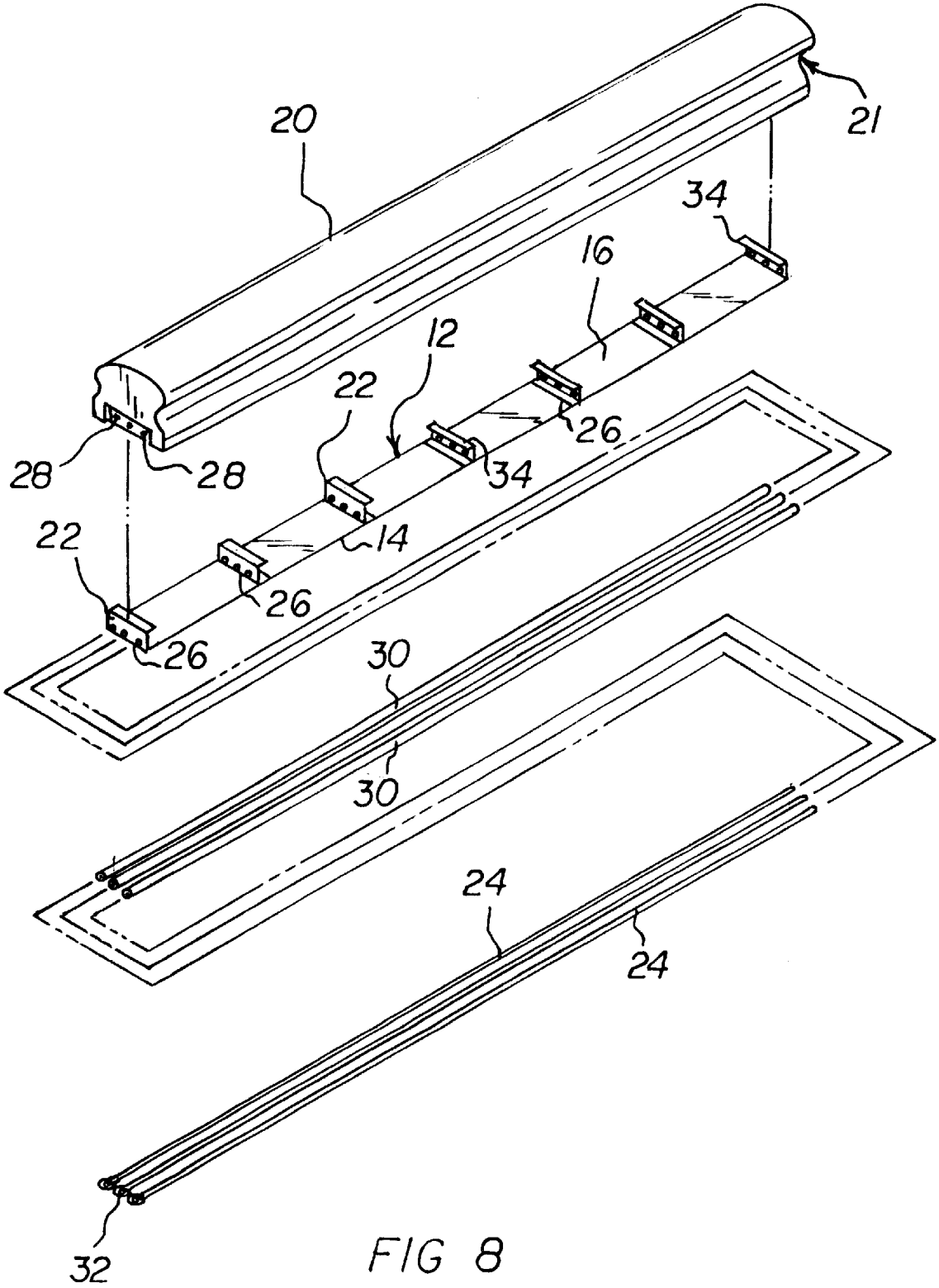
FIG. 8 is an exploded perspective view of the embodiment of the invention shown in FIGS. 1–5.

Turning to FIGS. 1–8, there is shown an exemplary embodiment of the adjustable flexibility sanding apparatus of the invention generally designated by reference numeral 10. In its preferred form, adjustable flexibility sanding apparatus 10 includes a flexible base member 12 which includes a base member bottom side 14 and a base member top side 16. A quantity of abrasive material is attached to the base member bottom side 14. A flexible handle 20 is positioned above the base member top side 16, and attachment means are provided for attaching the flexible base member 12 to the flexible handle 20. The adjustable flexibility sanding apparatus 10 of the invention can be used for sanding curved surfaces, such as curved surfaces on automobile bodies. FIG. 7 is a schematic depiction showing the adjustable flexibility sanding apparatus 10 curved to fit an automobile fender 11. The flexible handle 20 includes a pair of finger grip grooves 21. The flexible base member 12 is made from stainless steel.

More specifically, the flexible base member 12 can be made from 304-Grade stainless steel. Also, the use of 316-Grade stainless steel is contemplated. The flexible base member 12 can be 2 ½ inches wide so that a 3 inch wide sheet of sandpaper will wrap around the edge of the flexible base member 12. Alternatively, if desired, the flexible handle 20 can extend downward to cover the edges of the flexible base member 12. The abrasive material is in a form of a sheet of sandpaper 18 which preferably is adhesively bonded to the base member bottom side 14. For example, a sheet of sandpaper 18 can be adhered to a stainless steel base member bottom side 14 using 77 Adhesive, of 3M Company, Minneapolis, Minn. Another suitable adhesive for adhering a sheet of sandpaper 18 to a stainless steel base member bottom side 14 is Super Pol-Grip Denture Adhesive. Any other suitable adhesive, that cures into a flexible state, can be employed.

Rod reception brackets 22 are attached to the base member top side 16, and one or more flexibility adjustment rods 24 are received in the rod reception brackets 22. The rod reception brackets 22 include bracket rod reception channels 26 which receive the flexibility adjustment rods 24. Each of the rod reception brackets 22 includes three bracket rod reception channels 26. It is understood that each of the rod reception brackets 22 can have any suitable number of bracket rod reception channels 26 to accommodate a suitable number of flexibility adjustment rods 24.

The attachment means for attaching the flexible base member 12 to the flexible handle 20 can include adhesive action between the flexible handle 20 and the flexible base member 12 when the flexible handle 20 is molded to the flexible base member 12. In this respect, the flexible handle 20 can be made from a flexible foam material. Further, in this respect, the flexible handle 20 can be comprised of a castable transparent urethane elastomer, such as Fast Flex, or TC-276 A/B self skinning flexible foam, both made by BJB Enterprises, Inc., Garden Grove, Calif. Another material suitable for molding the flexible handle 20 to the flexible base member 12 is VI-SIL(TM), V-1065, of Rhone-Poulenc Silicones VSI North America, Troy, N.Y.

Also, the attachment means for attaching the flexible base member 12 to the flexible handle 20 can include attachment wings 34 on the rod reception brackets 22 and wing reception spaces 36 in the flexible handle 20 which receive the attachment wings 34. The flexible handle 20 includes handle rod reception channels 28 which are in registration with the bracket rod reception channels 26. Flexible plastic rod reception tubes 30 are received in the bracket rod reception channels 26 and the handle rod reception channels 28. Preferably, the bracket rod reception channels 26 are positioned adjacent to the base member top side 16 such that the rod reception tubes 30 are flush with the base member top side 16 when the rod reception tubes 30 are installed in the bracket rod reception channels 26. In addition, each of the flexibility adjustment rods 24 includes a rod handle portion 32.

Three flexibility adjustment rods 24 can be employed for rod reception brackets 22. In this respect, each of the rod reception brackets 22 includes three bracket rod reception channels 26. When one flexibility adjustment rod 24 is employed, the one flexibility adjustment rod 24 can be threaded through the central bracket rod reception channel 26 in each rod reception bracket 22. When two flexibility adjustment rods 24 are employed, the two flexibility adjustment rods 24 can be threaded through the two lateral bracket rod reception channels 26 in each rod reception bracket 22.

The flexibility adjustment rods 24 can be provided as a set of a plurality of flexibility adjustment rods 24 which have increasing resistance to bending. As shown in FIG. 6, the flexibility adjustment rods include flexibility adjustment rod 24*a* of lowest resistance to bending, flexibility adjustment rod 24*b* of intermediate resistance to bending, and flexibility adjustment rod 24*c* of greatest resistance to bending. Resistance to bending of a particular rod is a function of the rod's diameter. Hence, the desired degree of resistance to bending may be selected by using rods of the same predetermined diameter, or by selecting a set of rods of different diameter. Also, as shown in FIG. 6, flexibility adjustment rod 24*a* includes rod handle portion 32*a*, flexibility adjustment rod 24*b* includes rod handle portion 32*b*, and flexibility adjustment rod 24*c* includes rod handle portion 32*c*.

Although the abrasive material is shown to includes a sheet of sandpaper 18, other suitable forms of abrasive material can also be employed.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved adjustable flexibility sanding apparatus that is low in cost, relatively simple in design and operation, and which may advantageously be used with only one hand for efficient usage. With the invention, an adjustable flexibility sanding apparatus is provided which has a work-contacting portion that is in direct contact with the handle that supports the work-contacting portion. With the invention, a sanding apparatus provides for adjustment of the flexibility of the handle. With the invention, an adjustable flexibility sanding apparatus provides for handle flexibility adjustments to be carried out in distinct increments. With the invention, an adjustable flexibility sanding apparatus provides that incremental adjustment of handle flexibility is accomplished by interchangeable, modular flexibility adjustment elements.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use. Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A sanding apparatus, comprising:

a flexible base member which includes a base member bottom side and a base member top side, said base member bottom side defining a surface for receiving a quantity of abrasive material attached thereto, a flexible handle positioned above said base member top side, attachment means for attaching said flexible base member to said flexible handle, rod reception brackets attached to said base member top side, and one or more flexibility adjustment rods received in said rod reception brackets.

2. The apparatus of claim 1 wherein said rod reception brackets include bracket rod reception channels which receive said flexibility adjustment rods.

3. The apparatus of claim 2 wherein said flexible handle includes handle rod reception channels which are in registration with said bracket rod reception channels.

4. The apparatus of claim 2 wherein each of said rod reception brackets includes three bracket rod reception channels.

5. The apparatus of claim 2, further including:

rod reception tubes received in said bracket rod reception channels and said handle rod reception channels.

6. The apparatus of claim 5 wherein said bracket rod reception channels are positioned adjacent to said base member top side such that said rod reception tubes are flush with said base member top side when said rod reception tubes are installed in said bracket rod reception channels.

7. The apparatus of claim 5 wherein said flexibility adjustment rods are removably and interchangeably received in said rod reception tubes.

8. The apparatus of claim 1 wherein each of said flexibility adjustment rods includes a rod handle portion.

9. The apparatus of claim 1 wherein said flexibility adjustment rods are provided as a set of a plurality of flexibility adjustment rods which are increasing resistance to bending.

10. The apparatus of claim 1 wherein said flexible handle includes a pair of finger grip grooves.

11. The apparatus of claim 1 wherein said flexible base member is made from stainless steel.

12. The apparatus of claim 1 wherein said quantity of abrasive material comprises a sheet of sandpaper adhesively bonded to said base member bottom side.

13. The apparatus of claim 12 wherein said attachment means for attaching said flexible base member to said flexible handle includes adhesive action between said flexible handle and said flexible base member when said flexible handle is molded to said flexible base member.

14. The apparatus of claim 1 wherein said flexible foam handle is molded to said flexible base member.

15. The apparatus of claim 1 wherein said attachment means for attaching said flexible base member to said flexible handle include:

attachment wings on said rod reception brackets, and wing reception slots in said flexible handle for receiving said attachment wings.

16. The apparatus of claim 1 wherein said flexible handle can be made from a flexible foam material.

17. The apparatus of claim 16 wherein said flexible foam material is a urethane elastomer.

18. The method of making an adjustable flexible sanding apparatus comprising the following steps:

(a) providing a flexible base member having a pair of opposed sides, (b) attaching at least one adjustable flexibility member to one of said opposed sides of said flexible base member, (c) molding a flexible handle about said base member and said adjustable flexibility member.

19. The method of claim 18 comprising the further step of:

(d) attaching a quantity of abrasive material to said other opposed side of said flexible base member after said step of molding a flexible handle about said base member and said adjustable flexibility member.

* * * * *